United States Patent [19]

Clark

[11] 4,255,009

[45] Mar. 10, 1981

[54] TWO ROW ELECTRICAL CONNECTOR

[75] Inventor: Donald R. Clark, York, Pa.

[73] Assignee: AMP Incorporated, Harrisburg, Pa.

[21] Appl. No.: 62,207

[22] Filed: Jul. 30, 1979

[51] Int. Cl.[3] ..... H01R 11/20

[52] U.S. Cl. ..... 339/97 P; 339/99 R

[58] Field of Search ..... 339/96, 97 R, 97 P, 339/98, 99 R

[56] References Cited

U.S. PATENT DOCUMENTS

| | | | |
|---|---|---|---|
| 3,985,416 | 10/1976 | Dola et al. | 339/98 |
| 4,047,785 | 9/1977 | Jayne | 339/99 R |
| 4,074,929 | 2/1978 | Krider | 339/97 R |
| 4,138,189 | 2/1979 | Knopp | 339/97 P |
| 4,159,158 | 6/1979 | Weidler | 339/97 P |
| 4,190,952 | 3/1980 | Thomas et al. | 339/99 R X |

FOREIGN PATENT DOCUMENTS

| | | | |
|---|---|---|---|
| 2002599 | 2/1979 | United Kingdom | 339/99 R |

*Primary Examiner*—Eugene F. Desmond

*Attorney, Agent, or Firm*—Gerald K. Kita

[57] ABSTRACT

The two row electrical connector comprises an insulating housing having a mating face, a wire-receiving face and oppositely directed endwalls and sidewalls extending between the faces. Two parallel rows of contact-receiving cavities extend from the wire-receiving face to the mating face, each cavity having a contact terminal therein. The housing comprises two parts, a housing body, and a separate housing cover. The cavities are provided on the housing body and the terminals have wire-receiving portions which are oriented such that they receive wires upon movement of the wires laterally towards the housing sidewalls and into the cavities. The housing cover is assembled to the housing by moving the cover over the mating face of the connector and towards the wire-receiving face. The terminals are assembled to the housing body by moving them laterally towards the housing body and the cavities have supporting means for supporting the wire-receiving portions of the terminals during movement of the wires into the wire-receiving portions.

8 Claims, 7 Drawing Figures

TWO ROW ELECTRICAL CONNECTOR

FIELD OF THE INVENTION

This invention relates to electrical connectors, particularly of the type having terminals therein which are connected to wires by moving the wires laterally of their axes and into wire-receiving portions of the terminals.

BACKGROUND OF THE INVENTION

U.S. Pat. No. 4,159,158 discloses and claims an improved electrical connector of the type having solderless terminals therein of the wire-in-slot type. Wires are connected to terminals of this type by simply aligning the wires with wire-receiving slots in the terminals and moving the wires laterally of their axes and into the slots. The width of the slots in the terminals is such that the opposed edges of the slots penetrate the insulation of the wires and establish electrical contact therewith.

Connectors having wire-in-slot type terminals therein offer particular advantages in that it is possible simultaneously to connect a plurality of wires to a like number of terminals by moving all of the wires simultaneously into the wire-receiving portions of the terminals, operations which can be carried out by any one of several types of insertion tools and machines which are presently available.

When a wire is moved into a wire-receiving slot of a terminal, substantial stresses are imposed on the wire-receiving portion of the terminal and since the terminals are frequently of relatively thin metal stock, the stresses imposed during this process can cause damage to the terminals. The above identified U.S. Pat. No. 4,159,158 discloses a means in the connector housing for supporting the wire-receiving portion of each terminal in a connector during the wire-inserting operation and isolating the stresses which are imposed on the terminal so that they are not transmitted to the contact portions of the terminal to which they might cause damage. The features described in this prior U.S. Patent permit the use of wire-in-slot terminals with wires of a coarser gage than would otherwise be possible and thereby greatly increase the circumstances under which such connectors can be used.

As mentioned above, the connector shown and described in U.S. Pat. No. 4,159,158 is a single row connector, that is, it has only one row of terminals in the housing. While single row connectors are very widely used, there is also a demand for connectors having two rows of terminals therein and the present invention is directed to the achievement of a two row electrical connector having all of the advantageous features of a connector constructed in accordance with the above identified U.S. patent.

A connector in accordance with the invention has a housing composed of two housing parts, a housing body and a separate housing cover. The housing body has one surface which forms the wire-receiving face of the assembled connector and a central rib extends normally from this section. Spaced-apart barriers are provided on the oppositely directed surfaces of this rib and these barriers have opposed walls which define the opposed walls of the terminal-receiving cavities of the connector. The opposed walls of the barriers also have supporting shoulders thereon in accordance with the principles of U.S. Pat. No. 4,159,158 which support the wire-receiving portions of the terminals particularly during insertion of wires into these wire-receiving portions. The terminals are assembled to the housing body by positioning a terminal in alignment with each cavity and moving the terminal laterally of its axis until it is located in its cavity with the supporting shoulder means in supporting relationship to the wire-receiving portions of the terminals. The housing cover is partially assembled to the housing body after the terminals have been assembled to the housing body in a manner such that the cover becomes part of the body but the wire-receiving portions of the terminals are exposed to permit movement of wires laterally of the sidewalls of the housing and into the wire-receiving portions. After such movement of the wires into the terminals, the wires will extend axially from the rearward or wire-receiving face of the housing. The cover can then be moved to a fully assembled position in which the cover extends over the wire-receiving portions of the terminals and the terminals are therefore fully enclosed in the housing.

PRACTICE OF THE INVENTION

Figure 3:
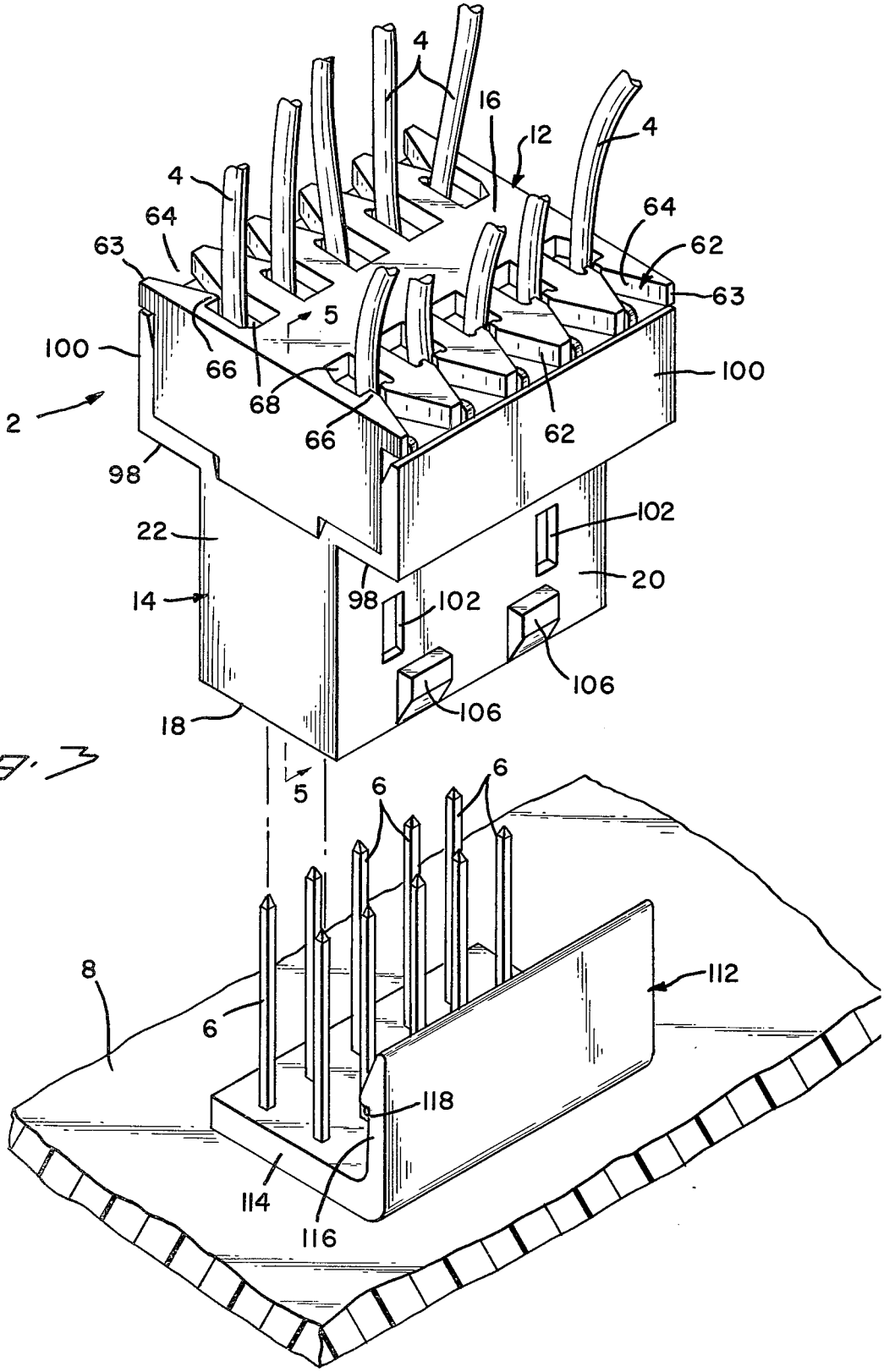
FIG. 3 is a perspective view showing the connector in its fully assembled position having rows of terminal pins with which the connector is adapted to be mated.

A connector assembly 2, FIG. 3, in accordance with the invention, serves to connect wires 4 to terminal posts 6 arranged in two parallel rows on a circuit board or other panel member 8. The posts 6 may be soldered to conductors on the underside of the circuit board or may have wrap-type connections on their ends on the underside of the circuit board.

Figure 2:
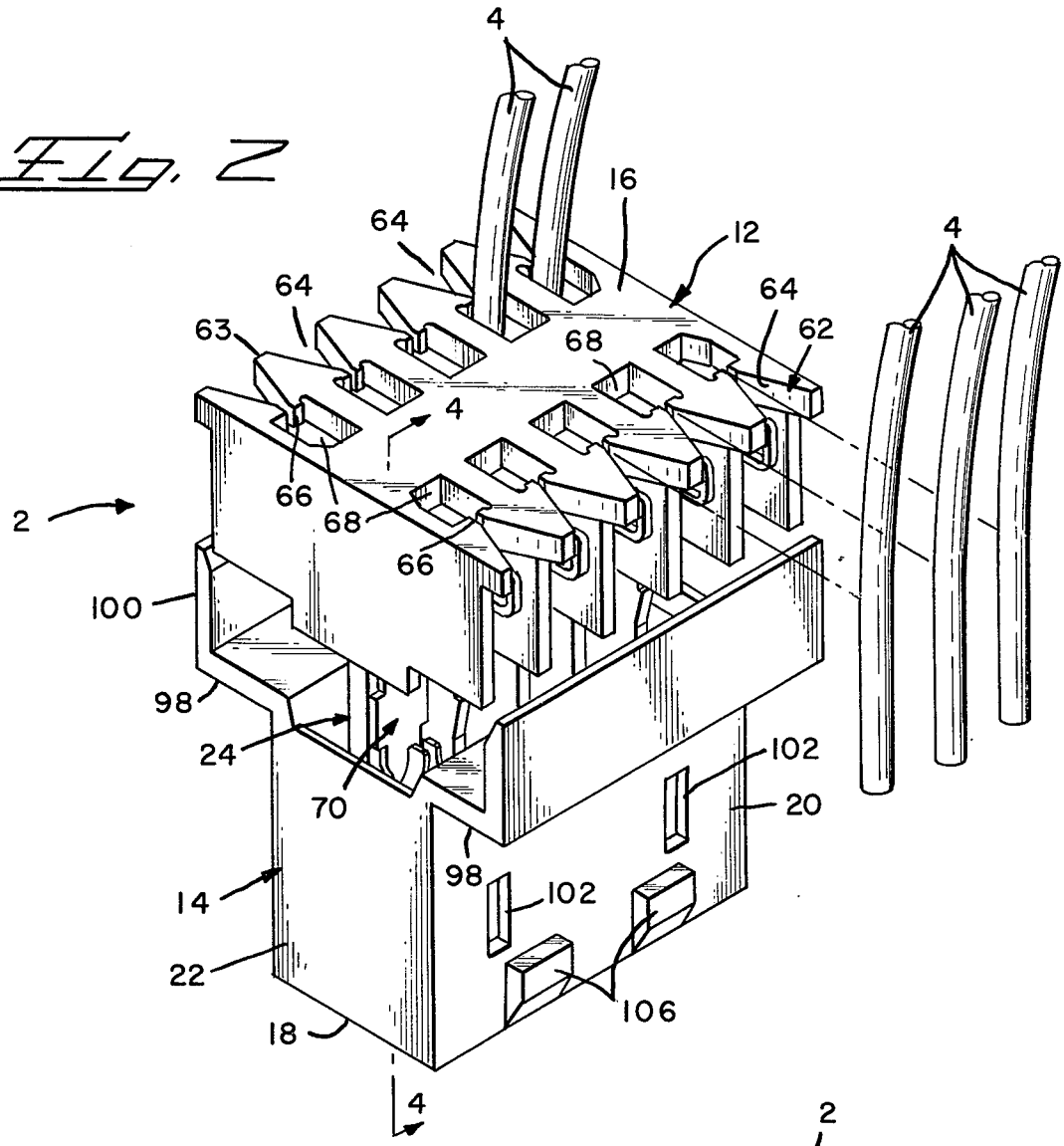
FIG. 2 is a view showing the housing cover in its partially assembled position on the housing body and showing wires in alignment with the terminals in the housing body preparatory to movement of the wires into the terminals.
Figure 6:
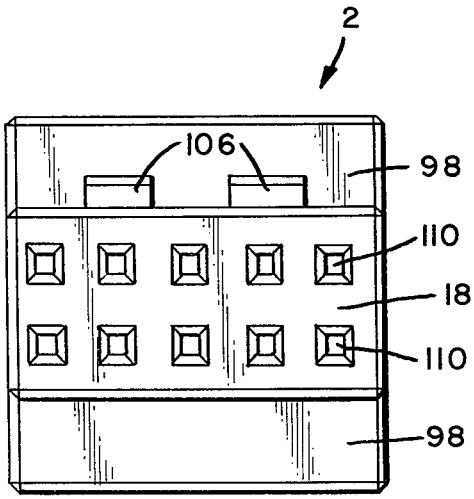
FIG. 6 is a frontal view of the mating face of the connector.

The connector assembly 2 comprises a housing assembly 10, FIG. 2, which is made up of a housing body 12 and a housing cover 14. Both of these parts of the housing are of insulating material such as a nylon molding composition. The housing assembly has a wire-receiving face 16 which is on the housing body 12 and a mating face 18 which is part of the housing cover 14. Oppositely directed sidewalls 20 and the oppositely directed endwalls 22 extend between the two faces, the sidewalls being part of the housing cover while the endwalls are formed by portions of both the body 12 and the cover 14.

Figure 7:
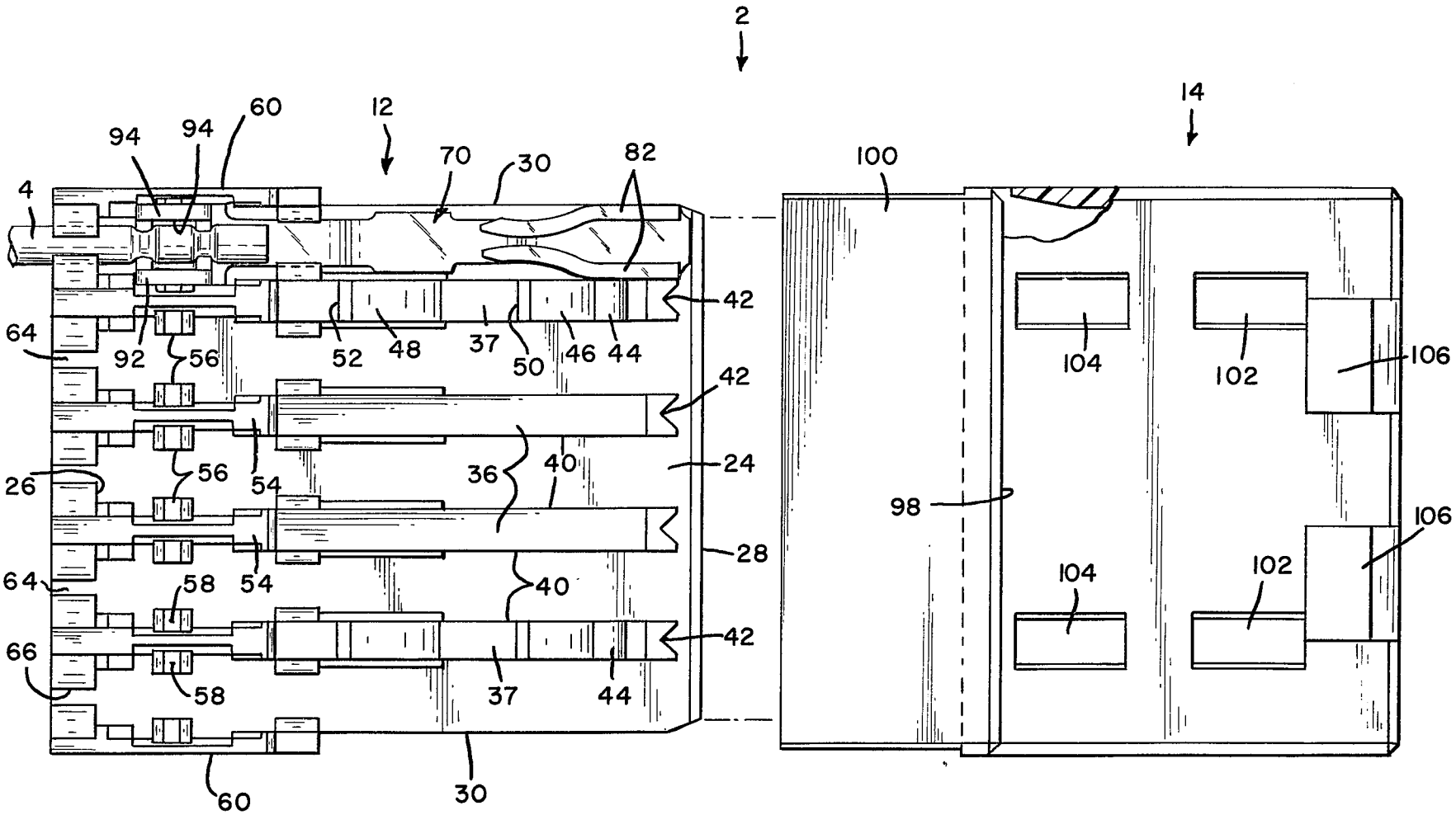
FIG. 7 is a plan view showing the housing body and the housing cover in alignment with each other.

The housing body 12 has a central rib 24 which extends from the internal surface 26 of the generally rectangular section which forms the wire-receiving face 16. This rib has a free end 28, parallel side edges 30, FIG. 7, and oppositely directed surfaces 38. The outer portions of the rib which are remote from the surface 26 are relatively thin, while the portions which are adjacent to the surface 26 are relatively thick and are connected to the outer portions by a transition section 32.

Spaced-apart barriers 36, 37 extend from the surfaces 38 and from the surface 26 towards the outer end 28 of the rib. The barriers 37 are proximate to, but spaced from the side edges 30, while the barriers 36 are between the barriers 37 and are centrally located on the surfaces 38. The opposed walls 40 of the barriers define cavity walls between which the terminals in the connector are located, the cavities which are adjacent to the side edges being also formed by internal surface portions of the cover member 14 as will be described below.

The outer ends of the barriers 36, 37 are notched, as shown at 42, for the reception of ribs 120 on an internal surface of the cover member and bosses 44 are provided on the barriers 37 adjacent to the ends of the barriers. These bosses and the notches 42 function precisely to locate the cover member 14 on the housing body 12 so that the terminals which are supported on the body will be in precise alignment with openings 110 in the cover. The upper edges of the barriers 37 are also provided with spaced-apart latch ears 46, 48 which define rearwardly facing shoulders 50, 52. These latch ears and shoulders cooperate with openings 102, 104 in the cover to provide a latching means for holding the cover in a partially assembled position, FIG. 4, and in a fully assembled position, FIG. 5, on the housing body.

The barriers 36, 37 have enlarged portions 54 adjacent to the surface 26 which receive the wire-receiving portions 74 of the terminals 70. Ribs 56 are provided on the opposed surfaces of these barriers adjacent to, but spaced from, the surface 26. The outer or the remote ends of these ribs define shoulders 58 which face laterally, as viewed in FIG. 4, and which provide support for the wire-receiving portions of the terminals when the wires are inserted into these wire-receiving portions, in accordance with the teachings of the above identified U.S. Pat. No. 4,159,158.

A barrier 60 is provided along each of the side edges 30 of the housing body and extends from the wire-receiving face substantially to the transition section 32 of the rib 24. These barriers 60, in cooperation with the barriers 37, thus define cavities for the wire-receiving portions 74 of the terminals 70 which are located immediately adjacent to the side edges 30 of the rib 24. As mentioned previously, the forward portions of the cavities which are adjacent to side edges 30 are formed by the side surfaces of the ribs 37 in cooperation with internal surface portions of the cover 14. It will be noted from FIG. 7 that the ribs 60 are of reduced thickness as compared with the ribs 36 and 37. The reduced thickness of these ribs 60 permits dimensioning of the connector such that two identical connectors can be stacked against each other and the spacing between the terminals from one connector to the other will be the same as the spacing between terminals in an individual connector. By virtue of this arrangement, connectors in accordance with the invention can be mated with terminal pins which extend from a circuit board in accordance with a grid system and no spacing is required between adjacent connectors.

The wires 4 are connected to the terminals 70 in the housing by moving the wires laterally of their axes and into wire-admitting slots 62 which extend inwardly from the edges 63 of the housing body 12. Each slot has an entrance portion 64 which merges with a constriction 66. The constriction in turn opens into a somewhat enlarged opening 68, the arrangement being such that the wire can be moved through the entrance, past the constriction, and into the opening 68, but it cannot be removed from the opening.

Figure 1:
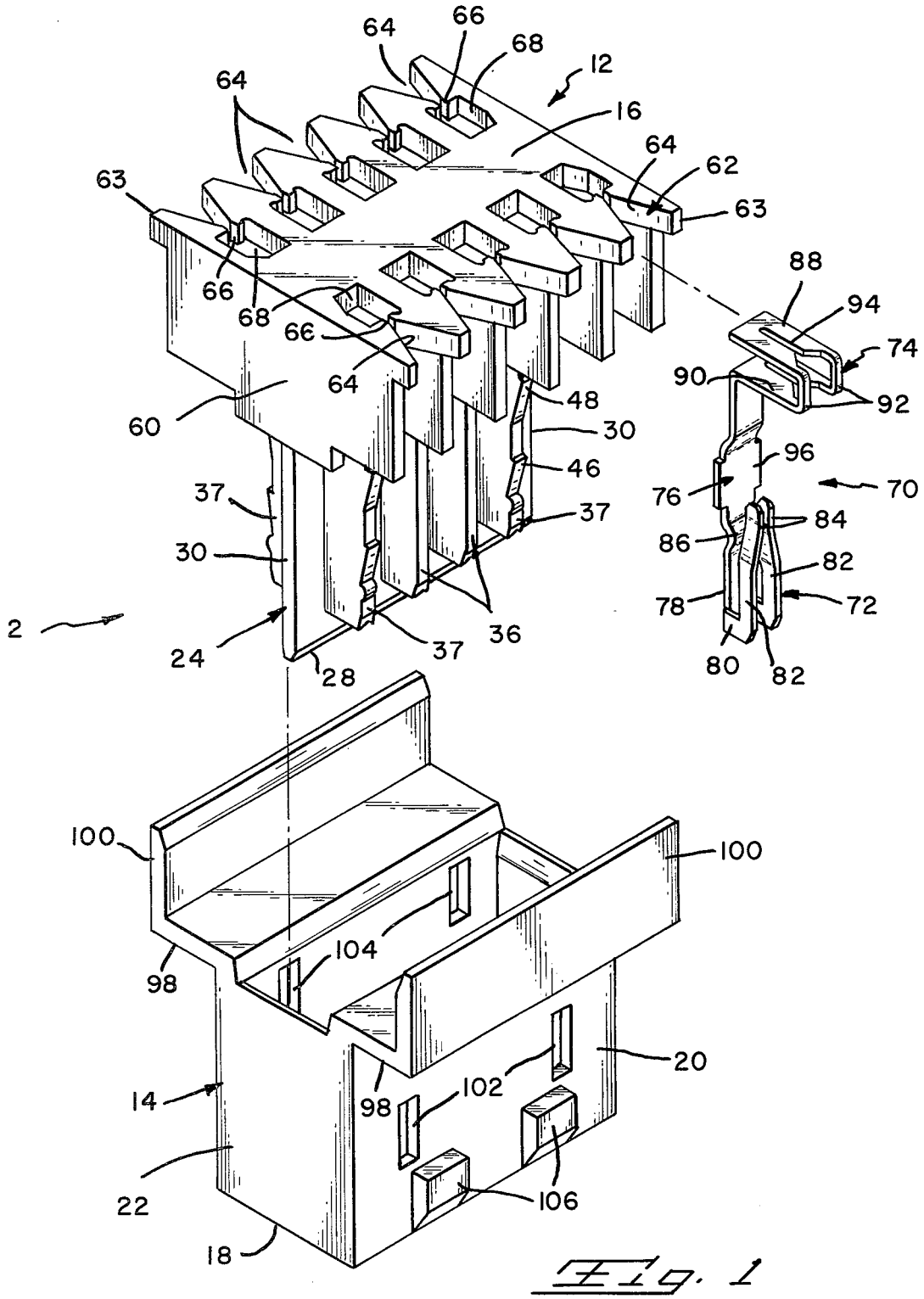
FIG. 1 is an exploded view of a housing body and a housing cover in accordance with the invention with the cover aligned with, but exploded from the housing body, and with one terminal exploded from the housing body.

As shown in FIG. 1, the terminals 70 are of stamped and formed conductive sheet metal, each terminal having a contact portion 72 at its forward end and a wire-receiving portion 74 at its rearward end, the two ends being connected by a web portion 76. The contact portion comprises laterally extending ears 80 which project from the side edges of the forward portion 78 of the web and rearwardly extending contact arms 82. These arms are formed inwardly and towards each other at their ends 84 so that they will engage a terminal post upon relative movement of the post into the space between the contact arms. The web is formed or bent towards the ends of the contact arms, as shown at 86, in order to maintain the alignment of the terminal with a contact post.

The wire-receiving portion 74 of each terminal comprises a pair of parallel plate-like members 88, 90 which are connected to each other by spaced-apart straps 92 at their outer ends. Each plate-like member has a wire-receiving slot 94 therein so that the wire can be moved laterally of its axis between the straps 92, and into the slots 94.

The central section of the web is enlarged as shown at 96, and the opposed walls 40 of the barriers of the housing body are provided with surface portions which provide a force fit of each terminal in its cavity. The terminals are produced by die stamping and forming methods as a continuous strip. The terminals can be removed from the strip and inserted into the housing body by automatic or semi-automatic assembly machines.

Figure 4:
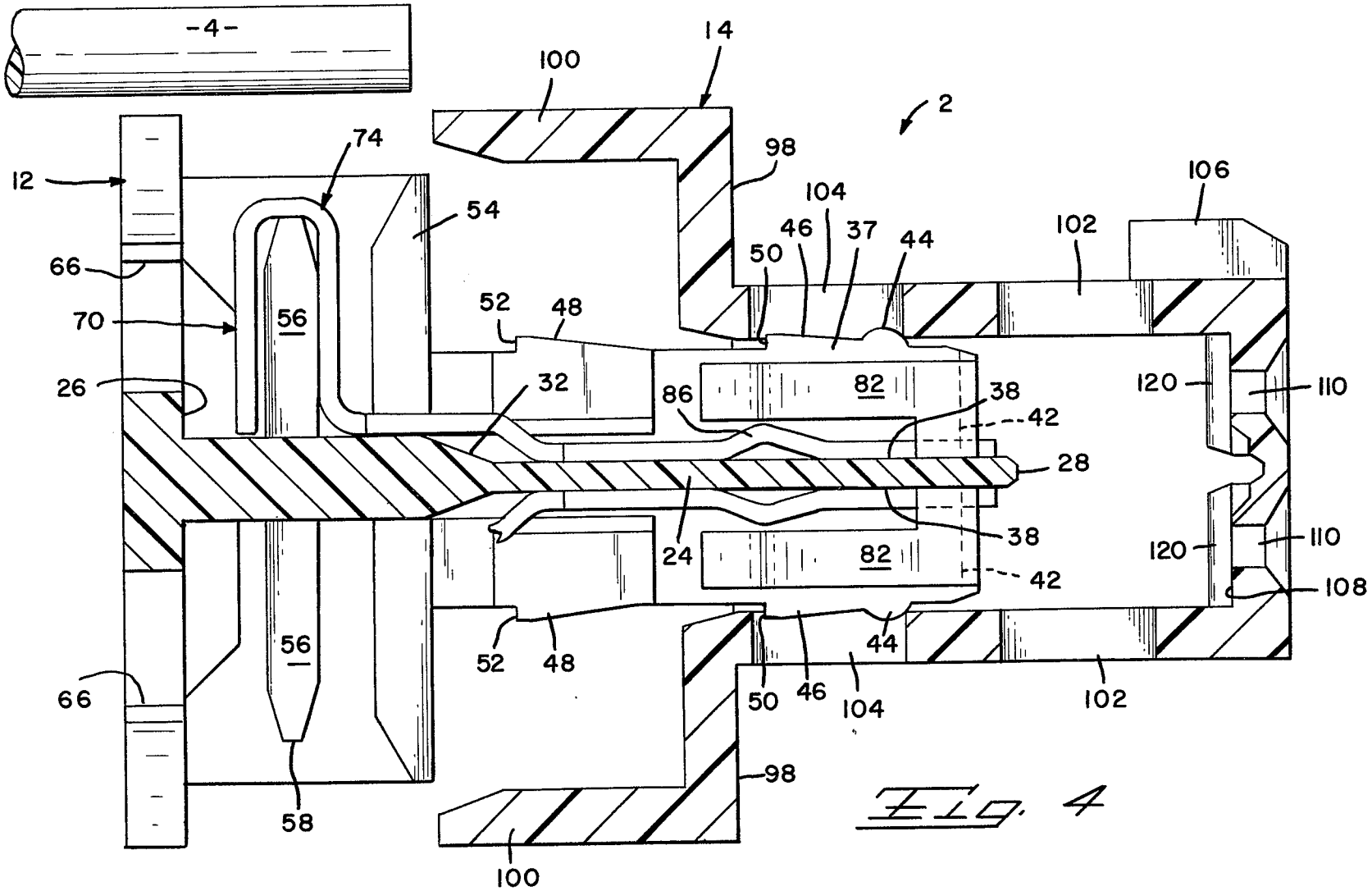
FIGS. 4 and 5 are cross-sectional views taken along the lines 4—4 of FIG. 2 and 5—5 of FIG. 3, respectively.
Figure 5:
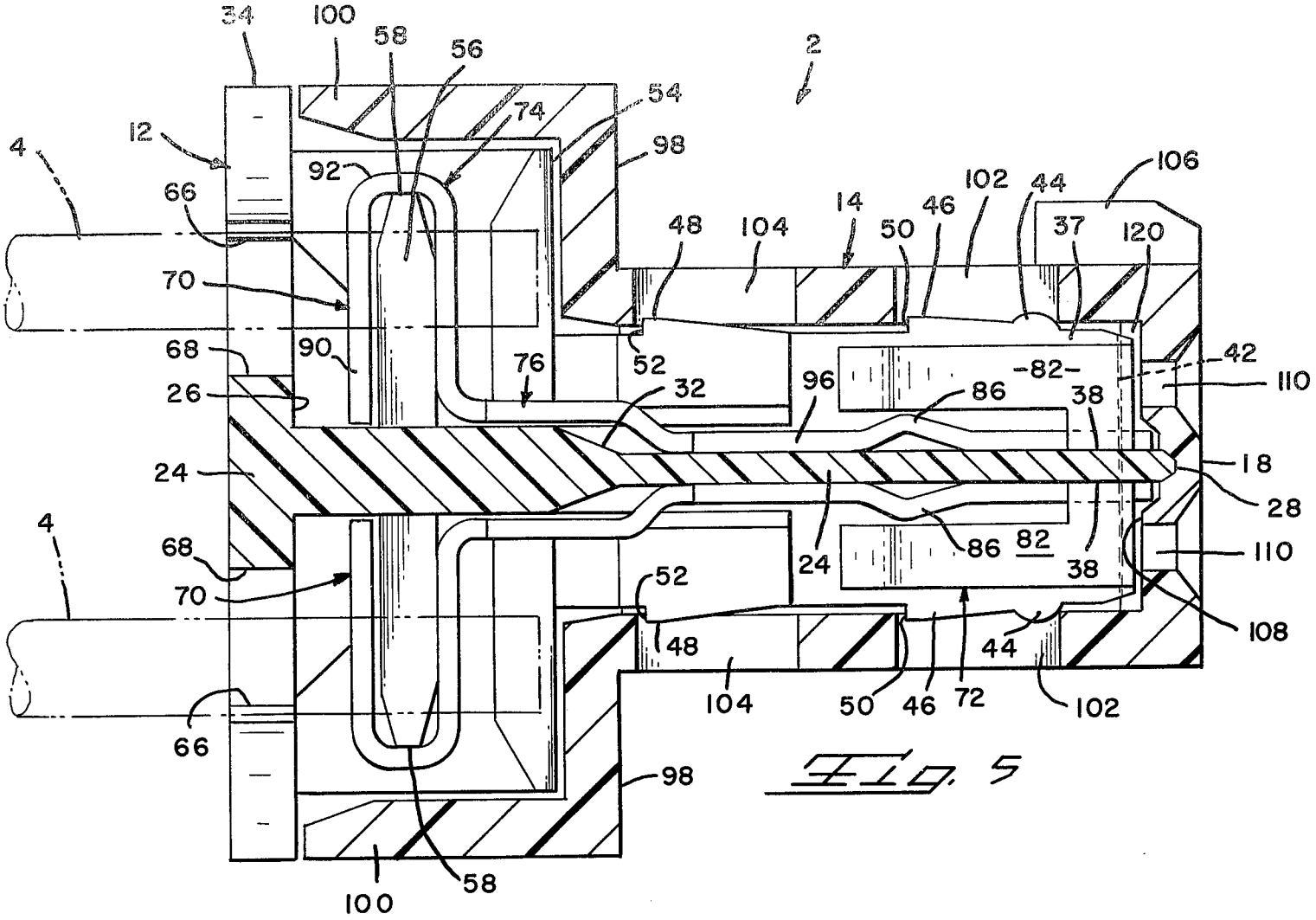

The cover member 14 is dimensioned to receive the forward end of the housing and its sidewalls 20 are offset outwardly, as shown at 98, for the accommodation of the enlarged portions of the barriers 36, 37. Flanges 100 extend from the ends of the offset portions and these flanges will extend over the terminals when the housing cover is fully assembled to the housing body. The sidewalls 20 are provided with openings 102, 104 which cooperate with the latch ears 46, 48 as shown in FIGS. 4 and 5, to hold the housing cover in either its partially assembled position or its fully assembled position. The external surface of the sidewall 20 is also provided with bosses 106 adjacent to the mating face 20 for cooperation with locking means 118 on a terminal post header 112 as described below. The internal surface 108 of the front wall of the housing cover is provided with the ribs 120, previously identified, which are received in the notches 42 of the barriers 36, 37. Openings extend from the surface 108 through the front wall to the mating face 18 to permit entry of the posts 6.

The terminal post 6 are mounted in the header 112 which comprises a generally L-shaped extrusion having a base 114 and an upwardly extending flange 116. A lip 118 is provided on this flange so that when the connector assembly 2 is mated with the posts 6, the flange 116 will be flexed outwardly until the bosses 106 move past the lip 118. The lip 118 and the bosses 106 thus prevent accidental removal of the connector from its mated condition.

As explained above, the terminals 70 are assembled to the housing body 12, preferably by means of a suitable assembling machine, by removing each terminal from a strip of terminals and then moving the terminal laterally of its axis and towards the housing body 12. After assembly, the shoulders 58 will be against the internal surface portions of the straps 92. The cover 14 is thereafter partially assembled to the housing body by moving the cover relatively towards the body from the position of FIG. 1 to the position of FIGS. 2 and 4, in which the latch ears 48 are received in the openings 104 of the cover. The connector assembly in this condition can then be transported to a harness-making apparatus and wires 4 connected to the terminals as illustrated in FIG. 2. Thereafter, the cover is moved relative to the housing to its fully assembled position, FIGS. 3 and 5, in which the latch ears 46, 48 are received in the openings 102, 104 respectively. The bosses 44 on the barriers 37 and the ribs 120 on the internal surface 108 of the front wall of the housing accurately align the housing body with the housing cover so that the terminals will be in alignment with the openings 110.

It will be apparent from the foregoing that a connector, in accordance with the present invention, provides supporting shoulders 58 for the wire-receiving portions 74 of the terminals when the wires 4 are inserted into the terminals, as illustrated in FIG. 2. As explained in U.S. Pat. No. 4,159,158, substantial stresses are imposed on the terminal when the wire is inserted and under some circumstances, and with some types of terminals, damage to the terminal can result from these stresses. In the practice of the present invention however, the stresses take the form of tensile stresses imposed on the plate-like sections 88, 90 and bending stresses imposed on the strap members 92. These stresses are confined to a localized portion of the wire-receiving portion of the terminal and are not transmitted to the contact portion 72 so that no damage to the contact portion can take place. The result of the practice of the invention is that, other things being equal, a relatively thinner stock metal can be used in the manufacture of the terminals than would otherwise be necessary, or metal of a given thickness can be used to manufacture terminals which will accept relatively coarse wires.

The assembled connector, as shown in FIG. 2, provides all of the features and advantages which are normally required, such as stackability of connectors against each other and complete enclosure of the terminals in the connector housing.

I claim:

1. In an electrical connector having a housing body; elongated electrical terminals, each having a contact portion and a wire connecting portion; and a cover, partially assembled with said housing body, and, following electrical connection of electrical wires to said wire connecting portions, fully assembled with said housing body to cover said wire connecting portions, said connector characterized in that:

said housing body includes a rib and a plurality of barriers disposed along the length of said rib and defining laterally adjacent, elongated cavities having open sides facing outwardly away from said rib, said terminals being force fit between said barriers and disposed lengthwise along said cavities and supported lengthwise against said rib, each said wire connecting portion includes a pair of plate like members, having outer ends facing outwardly away from said rib toward a respective said channel open side and being joined by spaced apart straps on either side of slots defined in said plate like members from said outer ends thereof and along said plate like members toward said rib, said cover being slidable lengthwise over said cavities, said housing body having first latching means for latched registration with a first portion of said cover partially assembled over the open sides of cavities and engageable with a second portion of said cover assembled over said cavities and covering said wire connecting portions of said terminals.

2. The structure as recited in claim 1, wherein, said housing body includes second latching means engageable with said first portion of said cover when said cover is covering said wire connecting portions of said terminals.

3. The structure as recited in claim 1, wherein said first latching means is provided on at least one of said barriers facing outwardly away from said rib, and further including, second latching means provided on at least one of said barriers facing outwardly away from said rib.

4. The structure as recited in each of claims 1, 2 or 3, wherein, said first latching means comprises, a projecting, rounded boss and a projecting, wedge shaped, first latching ear in registration within opposite ends of an opening provided in said cover.

5. The structure as recited in each of claims 1, 2 or 3, wherein, said first latching means comprises, a projecting, rounded boss and a projecting, wedge shaped, first latching ear in registration within opposite ends of an opening provided in said cover, and said second latching means comprises a projecting, wedge shaped, second latching ear, spaced from said first latching ear in registration with said opening in said cover while the same covers said wire connecting portions of said terminals.

6. The structure as recited in each of claims 1, 2, or 3, wherein, each outermost ones of said barriers has a thickness less than the spacing between adjacent said terminals.

7. The structure as recited in each of claims 1, 2 or 3, wherein, said barriers are provided on opposite sides of said rib defining rows of said cavities on opposite sides of said rib.

8. The structure as recited in each of claims 1, 2 or 3, wherein, said barriers include shoulders supporting said straps in opposition to insertion of electrical wires laterally of their axes into and along said slots of said plate like members and toward said rib to establish electrical connections of said wires.

* * * * *